US005273401A

United States Patent [19]

Griffin

[11] Patent Number: 5,273,401

[45] Date of Patent: Dec. 28, 1993

[54] WRAPPED PAIRED BLADE ROTOR

[75] Inventor: Joseph T. Griffin, Charlotte, N.C.

[73] Assignee: The United States of America as represented by the Secretary of the Air Force, Washington, D.C.

[21] Appl. No.: 907,272

[22] Filed: Jul. 1, 1992

[51] Int. Cl.[5] ..... F01D 5/02

[52] U.S. Cl. ..... 416/193 R; 416/230; 416/244 A; 416/212 A

[58] Field of Search ..... 416/193 R, 212 A, 223 R, 416/223 A, 227 A, 229 A, 230, 244 A, 248, 194, 196 R

[56] References Cited

U.S. PATENT DOCUMENTS

| | | | |
|---|---|---|---|
| 3,373,928 | 3/1968 | Erwin et al. | 416/193 R |
| 3,456,917 | 7/1969 | Palfreyman et al. | 416/230 R |
| 3,532,438 | 10/1970 | Palfreyman et al. | 416/230 R |
| 3,532,439 | 10/1970 | Palfreyman et al. | 416/230 R |
| 3,758,232 | 9/1973 | Wallett | 416/230 R |
| 3,923,422 | 12/1975 | Ianniello et al. . | |
| 3,950,115 | 4/1976 | Euler . | |
| 4,098,559 | 7/1978 | Price | 416/230 R |
| 4,281,966 | 8/1981 | Duret et al. . | |
| 4,302,155 | 11/1981 | Grimes et al. . | |
| 4,626,173 | 12/1986 | Mouille et al. . | |
| 4,751,123 | 6/1988 | Broquere et al. . | |
| 4,786,347 | 11/1988 | Angus . | |
| 4,808,076 | 2/1989 | Jarmon et al. . | |
| 4,810,167 | 3/1989 | Spoltman et al. . | |
| 4,867,644 | 9/1989 | Wright et al. . | |

FOREIGN PATENT DOCUMENTS

| | | | |
|---|---|---|---|
| 6640 | 3/1908 | United Kingdom | 416/194 |
| 711703 | 7/1954 | United Kingdom | 416/230 R |

*Primary Examiner*—Edward K. Look
*Assistant Examiner*—James A. Larson
*Attorney, Agent, or Firm*—Fredric L. Sinder; Donald J. Singer

[57] ABSTRACT

A new lightweight bladed rotor for gas turbine or turbojet engines combines an inner support ring with blade straps made of fiber reinforced material. The blade straps wrap halfway around the inner support ring so that their ends extend radially outwardly to form blade pairs. A rim connects the blade straps near their ends to provide rigidity and to define a flowpath.

1 Claim, 4 Drawing Sheets

WRAPPED PAIRED BLADE ROTOR

RIGHTS OF THE GOVERNMENT

The invention described herein may be manufactured and used by or for the Government of the United States for all governmental purposes without the payment of any royalty.

BACKGROUND OF THE INVENTION

The present invention relates generally to bladed rotors for gas turbine or turbojet engines, and more particularly to a new lightweight bladed rotor configuration compatible with continuously-reinforced composite materials.

In conventional gas turbine engines, gases, generally atmospheric air, are compressed in a compressor section and then passed to a combustion section where fuel is added and the mixture burned to add energy to the gases. The now high energy combustion gases are next passed to a turbine section where a portion of the energy is extracted and applied to drive the engine compressor. The remaining still high energy combustion gases are then exhausted from the rear of the engine to provide forward thrust.

Typically, both the compressor and turbine sections include a number of alternate annular rows of fixed stator vanes and movable rotor blades. The stator vanes are generally attached to the inside circumferential wall of the turbine engine and extend radially inward. The rotor blades are generally attached to a rotor and extend radially outward. Each annular row of stator vanes directs the gases to a preferred angle of entry into a downstream annular row of rotor blades.

Modern, and future, high performance turbine engines place very high stresses on the rotors, primarily from centrifugal force. This force is also often termed an outward radial pull. High operating temperatures place an added burden on the ability of rotors and blades to withstand high centrifugal forces due to creep and reduced yield strength.

The traditional configuration for a highly stressed turbine engine rotor made of monolithic material is a disk. The blades are typically attached to the disk around its periphery. The rotor disk generally includes a hole in its center for a shaft.

To provide rotors and blades able to withstand higher stresses, the prior art has experimented with the use of composite materials in a variety of different configurations. A fuller description of those prior art approaches is included as part of the Detailed Description.

Unfortunately, these prior art attempts to utilize composite materials for rotor construction have not been completely successful. For example, the composite disks are difficult to manufacture, especially in larger rotor sizes. Differences in the coefficient of thermal expansion between the fibers and the matrix material can lead to high residual stresses after manufacture. High operating stresses can also result from the combination of thermal expansion, geometric constraints and lack of plasticity of the fibers in the composite. These stresses degrade both material properties and component performance. Layup of fibers can be difficult or tedious. Often, the disk will require a region near its center of thicker cross-section in order to withstand the higher stresses developed in that region. Woven or braided fibers, which can be used in the center region to provide the needed additional strength, can be very difficult to uniformly infiltrate with the matrix material due to the thickness of the cross-section. Finally, adding continuous fiber reinforcement desirably extending from the disk into the blades adds substantially to complexity and difficulty.

Thus it is seen that there is a need for new rotor and blade configurations which successfully take advantage of the physical properties of composite materials.

It is, therefore, a principal object of the present invention to provide a new blade and rotor configuration particularly compatible with continuously-reinforced composite materials.

It is a feature of the present invention that all of its component parts can be advantageously constructed using fiber reinforced composite materials.

It is an advantage of the present invention that its new configuration can be significantly lighter than typical prior art configurations.

It is another advantage of the present invention that it removes the problem of attachments and discontinuities in the highly stressed area of the attachment of blades to rotor disks.

It is a further advantage of the present invention that it will be simple and straightforward to manufacture.

These and other objects, features and advantages of the present invention will become apparent as the description of certain representative embodiments proceeds.

SUMMARY OF THE INVENTION

The present invention provides new configurations for bladed turbine engine rotors that are particularly compatible for use with continuously-reinforced composite materials. The unique discovery of the present invention is that blade pairs may be made with straps of reinforced composite material wrapped around an inner ring. This new bladed rotor configuration takes maximum advantage of the properties of reinforced composites and minimizes the problems found in prior art attempts to utilize reinforced composite materials.

Accordingly, the present invention is directed to a rotor for a turbine engine comprising a ring, a plurality of straps, each strap having two ends, and each strap wrapped halfway around the ring so that their ends extend radially away from the ring, and a rim, concentric with the ring and of greater radius, connecting the straps near their ends. Each strap end can be formed into the shape of a blade. Alternatively, a blade can be attached to each strap end. Each strap can be made of a fiber reinforced composite material and reinforcing fibers can extend from each strap end into each blade to help attach the blade to the strap end. The ring and the rim can each be made of fiber reinforced composite material. The straps can overlap other straps where they wrap around the ring.

DESCRIPTION OF THE DRAWINGS

The present invention will be more clearly understood from a reading of the following detailed description in conjunction with the accompanying drawings wherein.

DETAILED DESCRIPTION

Figure 1:
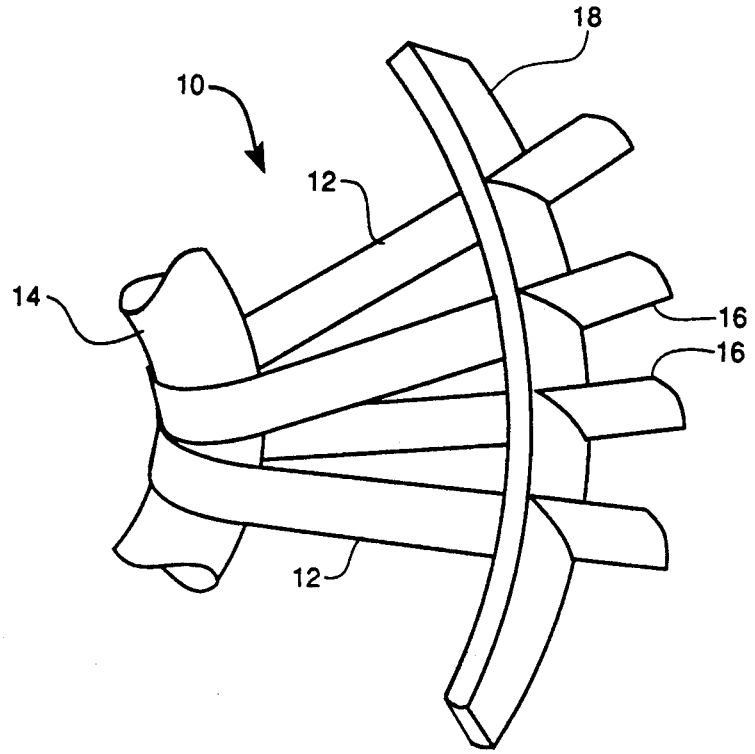
FIG. 1 is a simplified view of a lightweight bladed rotor configuration according to the teachings of the present invention showing two straps of reinforced composite material wrapped around an inner ring to form two pairs of blades.

Referring now to FIG. 1 of the drawings, there is shown a simplified view of a lightweight bladed rotor configuration 10 showing two example straps 12 of reinforced composite material wrapped around an inner support ring 14 to form two pairs of blades 16. An outer rim 18 attaches to straps 12 to provide rigidity and to define a flowpath for turbine engine gases.

The advantages of the present invention may be better understood after a description of the prior art.

Figure 3:
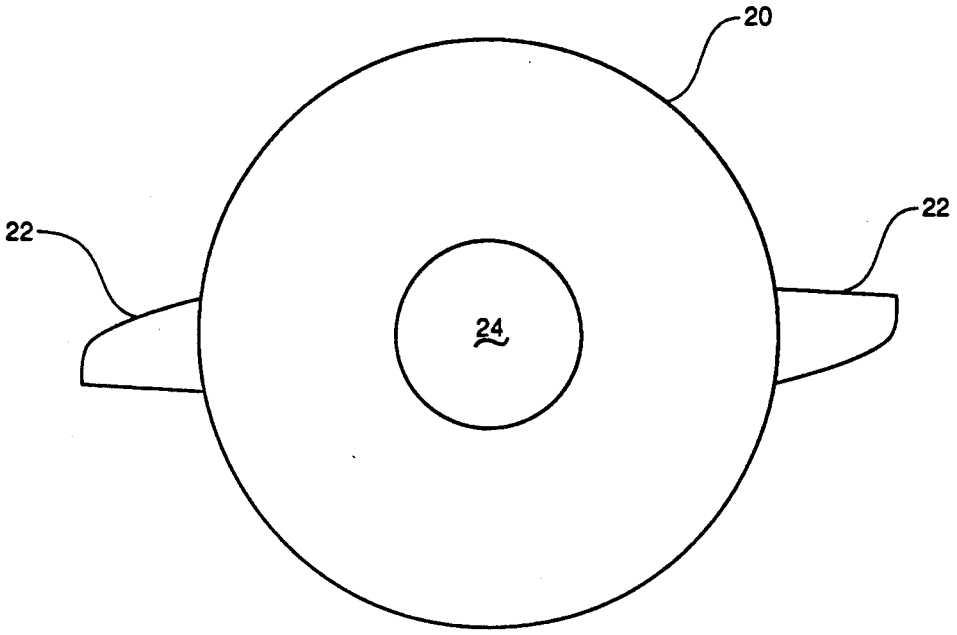
Fig. 3 Prior Art
FIG. 3 is a simplified view of a prior art monolithic turbine engine rotor and example attached blades.

FIG. 3 is a simplified view of a prior art monolithic turbine engine rotor 20 and example attached blades 22. Blades 22 extend completely around rotor 20. Only two blades 22 are shown for simplicity. A hole 24 is for passage of a shaft (not shown). In some applications, hole 24 is eliminated and other components are attached around the periphery of the rotor disk 20 to provide for imparting or receiving rotational forces. Rotor disk 20 typically will be made of monolithic aluminum, titanium or a nickel superalloy. This rotor configuration is the traditional configuration for highly stressed turbine engine rotors. During operation, the primary stresses in disk 20 and in blades 22 result from centrifugal forces.

Figure 4:
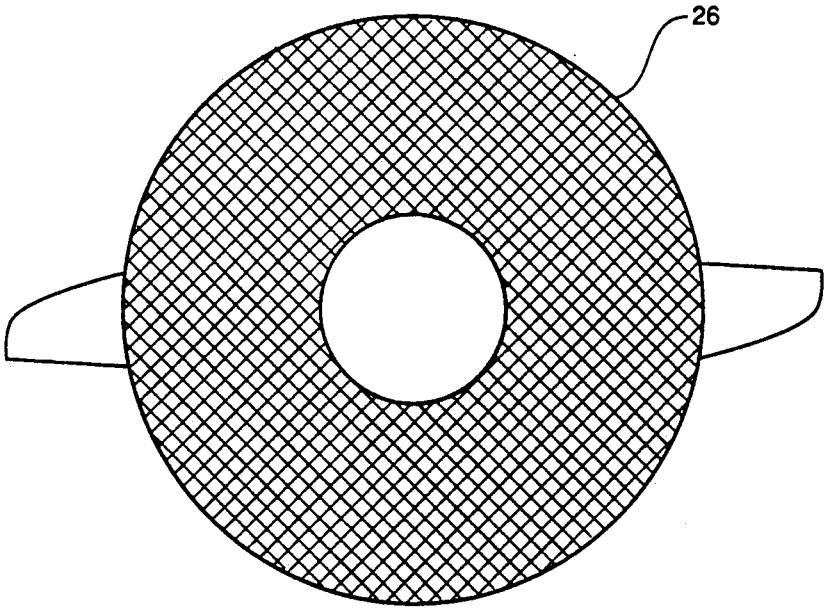
Fig. 4 Prior Art
FIG. 4 is a simplified view of another prior art turbine engine disk rotor made of reinforced composite material with a quasi-isotropic fiber orientation.
Figure 5:
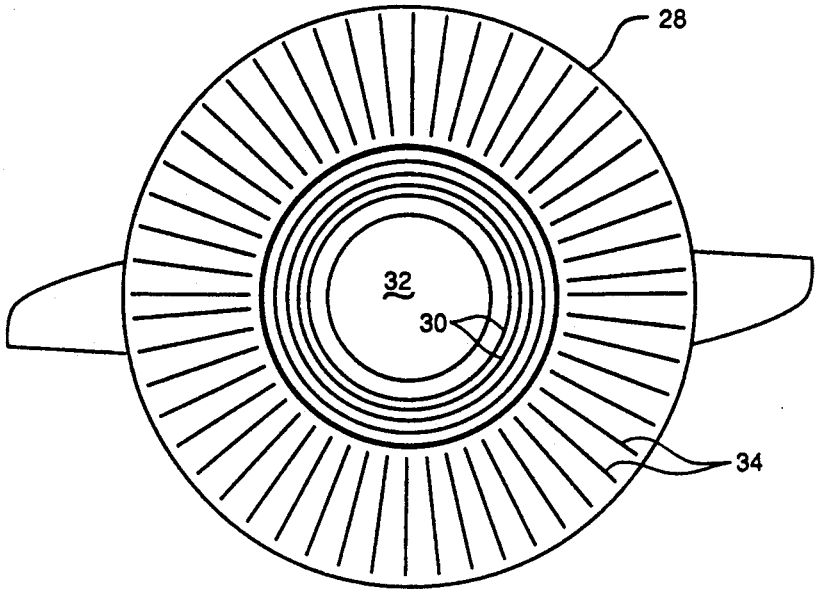
Fig. 5 Prior Art
FIG. 5 is a simplified view of another prior art turbine engine disk rotor made of reinforced composite material with a combination hoop and radial fiber orientation.

FIGS. 4 and 5 are simplified views of other prior art rotor disks 26 and 28 made of reinforced composite material for lighter weight and increased strength. The fibers may be oriented in a variety of ways. FIGS. 4 and 5 show two of the more common orientations. A quasi-isotropic layup in rotor disk 26 of FIG. 4 comprises several layers of composite material, each layer oriented in a different direction to provide a balanced, average value of material properties in any direction. Rotor disk 28 of FIG. 5 shows a layup of hoop fibers 30 near the bore 32 and radial fibers 34 in the rest of disk 28. Fibers 30 and 34 are oriented to follow the directions of principal stresses in both areas of disk 28. The fiber reinforcement may also be braided or woven.

Figure 6:
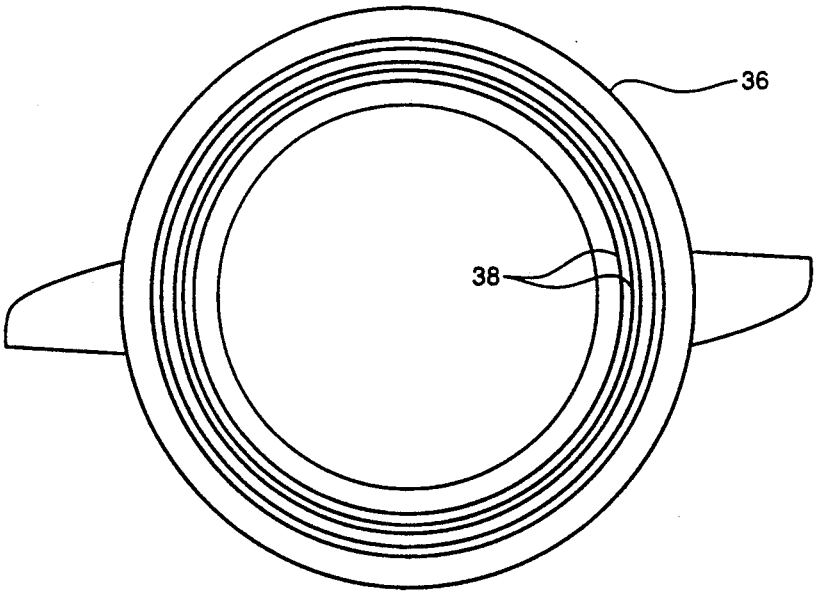
Fig. 6 Prior Art
FIG. 6 is a simplified view of a prior art turbine engine ring rotor made of reinforced composite material with a hoop fiber orientation; and, FIG. 7 is a simplified view of a prior art Novotny Composite Rotor made of paired blades wrapped around pins suspended between parallel rings.

FIG. 6 is a simplified view of a prior art ring rotor 36 made of reinforced composite material with a hoop fiber 38 orientation. The advantage of this configuration is that a rotor configuration comprised of material loaded primarily in one direction allows fiber orientation to be primarily in that direction, and also allows a geometry that does not impose severe residual stresses on the fibers during manufacture. A disadvantage of such ring rotors is that because the centrifugal stresses in a ring are proportional to the radius of the ring squared, a ring of the full rotor radius will require an unreasonably high specific strength (specific strength divided by density) material. And, as noted previously, continuous fiber reinforcement extending from the ring into the blades presents manufacturing difficulties.

Figure 7:
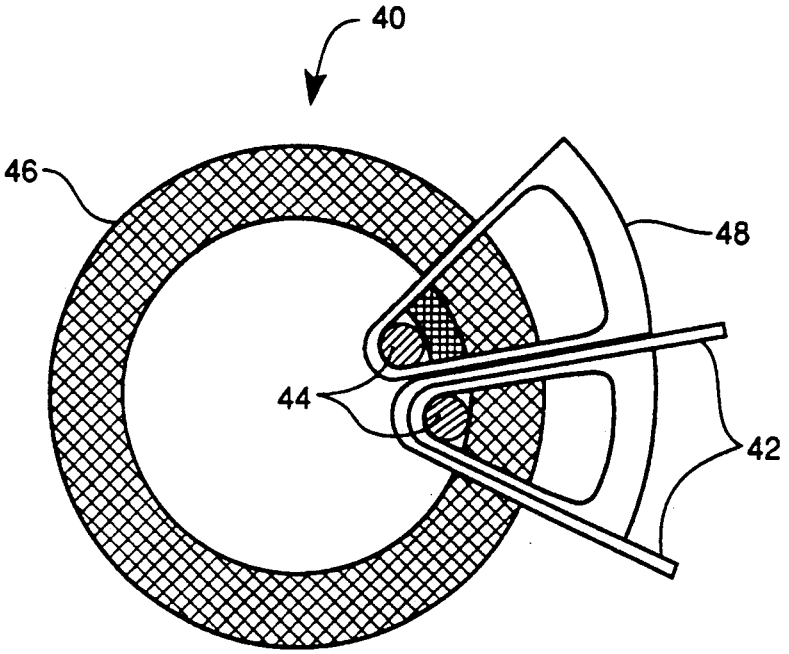
Fig. 7 Prior Art

FIG. 7 is a simplified view of a prior art Novotny Composite Rotor 40 made of paired blades 42 wrapped around pins 44 suspended between two parallel rings 46. Only one blade pair 42 and only the far side ring 46 are shown for clarity. Spacers 48 keep adjacent blade pairs 42 in proper position relative to each other. Each spacer 48 may be formed from a continuously reinforced strip of material supported by a pin 44 in the same manner as blade pairs 42. The Novotny Composite Rotor may be advantageously made from composite material. However, the number of blade pairs is limited by the minimum permissible bend radius of the reinforcing fibers in the blade pairs and spacers. Also, the stresses in the pins are very high, making a practical design difficult.

Returning now to FIG. 1, it can be seen how new rotor configuration 10 solves the problems inherent in the prior art. Inner support ring 14 has a relatively small radius, thus significantly reducing the rotational stresses placed on it. Both support ring 14 and outer rim 18 can be made of composite materials. Straps 12 are preferably made of unidirectionally reinforced composite material, but can also be made with braided, woven or multidirectional reinforcement, as long as the effect of the reinforcement is to preferentially strengthen straps 12 along their long axis. Different fiber orientations can also advantageously be used for support ring 14 and outer rim 18. The ends of straps 12 may function as blades 16, or may provide the reinforcement for blades attached to those ends. Ends 16 can be displaced from the radial direction and twisted as required to serve these functions. Rim 18 may be constructed of segments mechanically attached or bonded to the straps, and may include continuous fiber reinforcement. Most often, rim 18 would be made of a monolithic material.

In operation, the outward radial pull experienced by blades 16 and rim 18 is supported by straps 12. Straps 12, in turn, are supported by inner ring 14. Blade and strap aerodynamic and vibratory loads, rotor torque, and so forth, are supported by rim 18 or together by rim 18 and inner ring 14.

Figure 2:
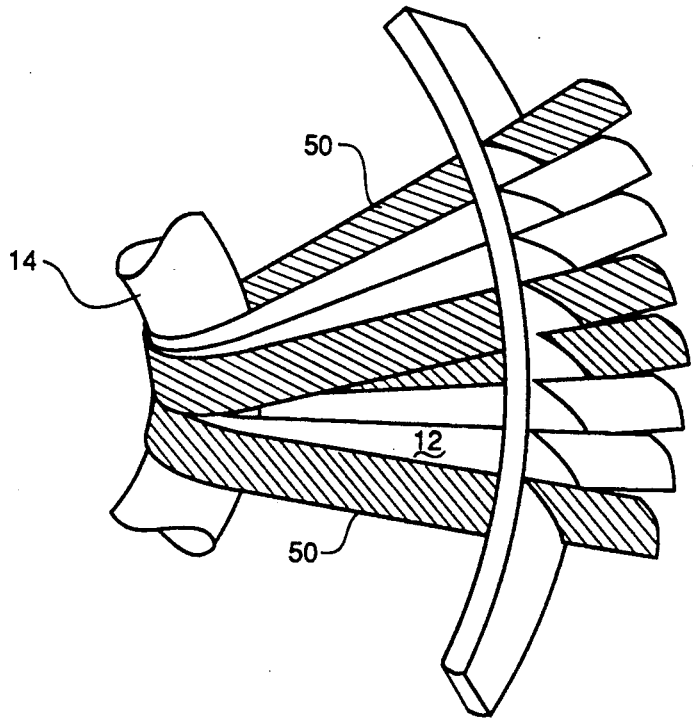
FIG. 2 is a simplified view of the lightweight bladed rotor configuration of FIG. 1 showing a modified configuration of additional blade straps overlapping the original blade straps to increase the number of blade pairs available.

FIG. 2 is another simplified view of lightweight bladed rotor configuration 10 showing the addition of overlapping blade straps 50 to increase the total number of blade pairs that can be attached to inner ring 14. Some blade straps are shaded to help visually distinguish among them. Approximately double the amount of blade pairs can be mounted on an inner ring in this manner.

The disclosed new bladed rotor successfully demonstrates the use of fiber reinforced blade straps wrapped around a small diameter inner support ring to made a lightweight turbine engine rotor. Although the disclosed apparatus is specialized, its teachings will find application in other areas where monolithic structures are now being used and where prior art attempted improvements to those monolithic structures have thus far been largely limited to material substitution.

It is understood that various modifications to the invention as described may be made, as might occur to one with skill in the field of the invention, within the scope of the claims. For example, its use is not limited to fiber reinforced materials. Therefore, all embodiments contemplated have not been shown in complete detail. Other embodiments may be developed without departing from the spirit of the invention or from the scope of the claims.

I claim:

1. A rotor for a turbine engine, comprising:

(a) a ring;

(b) a plurality of straps, each strap having two ends, and each strap wrapped halfway around the ring so that their ends extend radially away from the ring;

(c) a rim, concentric with the ring and of greater radius, connecting the straps near their ends; and (d) wherein some of the straps overlap other straps where they wrap around the ring.

* * * * *